US012196418B2

(12) United States Patent
Wiegmann et al.

(10) Patent No.: US 12,196,418 B2
(45) Date of Patent: Jan. 14, 2025

(54) COMBUSTION OF THE CO IN SECONDARY METALLURGICAL EXHAUST GAS, WITH CALORIFIC VALUE CONTROL AND VOLUME FLOW CONTROL

(71) Applicant: SMS group GmbH, Düsseldorf (DE)

(72) Inventors: Volker Wiegmann, Duisburg (DE); Frank Dorstewitz, Bottrop (DE); Andreas Kemminger, Düsseldorf (DE); Helmut Biehl, Cologne (DE)

(73) Assignee: SMS group GmbH, Düsseldorf (DE)

( * ) Notice: Subject to any disclaimer, the term of this patent is extended or adjusted under 35 U.S.C. 154(b) by 417 days.

(21) Appl. No.: 17/779,868

(22) PCT Filed: Nov. 23, 2020

(86) PCT No.: PCT/EP2020/083023
§ 371 (c)(1),
(2) Date: May 25, 2022

(87) PCT Pub. No.: WO2021/105045
PCT Pub. Date: Jun. 3, 2021

(65) Prior Publication Data

US 2022/0412554 A1 Dec. 29, 2022

(30) Foreign Application Priority Data

Nov. 27, 2019 (DE) ..... 10 2019 132 181.6

(51) Int. Cl.
*F23G 7/08* (2006.01)

(52) U.S. Cl.
CPC ..... *F23G 7/085* (2013.01); *F23G 2207/20* (2013.01); *F23G 2209/14* (2013.01);
(Continued)

(58) Field of Classification Search
CPC .. F23G 7/085; F23G 2207/20; F23G 2207/14; F23G 2209/14; F23G 2900/55003; F23G 2900/55011
(Continued)

(56) References Cited

U.S. PATENT DOCUMENTS 5,062,788 A * 11/1991 Best ..... F23D 14/64 431/328
5,980,606 A 11/1999 Sarma et al.
(Continued)

FOREIGN PATENT DOCUMENTS

DE 2315988 A1 11/1974
EP 0026118 A1 4/1981
(Continued)

*Primary Examiner* — Vivek K Shirsat
(74) *Attorney, Agent, or Firm* — Smartpat PLC

(57) ABSTRACT

A method for the post-combustion of exhaust gases comprising carbon monoxide from metallurgical processes includes conditioning the exhaust gas prior to post-combustion by metering a combustion gas and/or one additional gas in feedback-controlled fashion. The feedback control depends on the composition of the exhaust gas dependent on the exhaust gas volume flow. A device for post-combustion of exhaust gas during vacuum treatment of liquid steel comprises a flare stack at an exhaust outlet, means for feeding combustion gas to the flare stack, means for feeding an inert gas into the exhaust gas channel of the vacuum pump, means for ascertaining the exhaust gas volume flow and/or for measuring the exhaust gas velocity within the exhaust gas channel, means for analyzing the exhaust gas composition, means for metering the combustion gas and the inert gas, and means for feedback control of the metering of the combustion gas and/or the inert gas dependent on the exhaust gas composition.

16 Claims, 4 Drawing Sheets

(52) U.S. Cl.
CPC ..... *F23G 2900/55003* (2013.01); *F23G 2900/55011* (2013.01)

(58) Field of Classification Search
USPC ..... 431/18, 6, 202
See application file for complete search history.

(56) References Cited

U.S. PATENT DOCUMENTS

| | | | | |
|---|---|---|---|---|
| 6,042,633 | A | 3/2000 | Brotzmann et al. | |
| 2010/0071508 | A1 | 3/2010 | Matschullat | |
| 2014/0023577 | A1 | 1/2014 | Baldauf et al. | |
| 2015/0167972 | A1* | 6/2015 | Zhdaneev | F23N 5/003 431/14 |
| 2019/0218942 | A1* | 7/2019 | Murata | F01K 23/101 |
| 2019/0242575 | A1 | 8/2019 | Fisher et al. | |

FOREIGN PATENT DOCUMENTS

| | | | |
|---|---|---|---|
| EP | 2099940 | A1 | 9/2009 |
| EP | 2663661 | A2 | 11/2013 |
| WO | 2016123666 | A1 | 8/2016 |

* cited by examiner

COMBUSTION OF THE CO IN SECONDARY METALLURGICAL EXHAUST GAS, WITH CALORIFIC VALUE CONTROL AND VOLUME FLOW CONTROL

TECHNICAL FIELD

The disclosure relates to a method for the post-combustion of exhaust gases comprising carbon monoxide from metallurgical processes with discontinuously generated exhaust gas volumes, the composition and/or flow rate of which varies during a period within which exhaust gas is generated. Such metallurgical processes can be, for example, secondary metallurgical processes in which a metal melt is degassed or decarbonized.

BACKGROUND

Many metallurgical processes produce exhaust gases with low calorific value and chemical components such as carbon monoxide, which should not be released into the atmosphere without post-combustion.

In petrochemical and metallurgical processes, burning off gases with so-called "flare stacks" is generally known. Flare gases often have different qualities. To ensure that the flare burns steadily, the gas must have a minimum content of combustible components. If this is not the case, natural gas is added as a combustion gas if necessary. Calorimeters are typically used to determine the calorific value of the flare gas. These include a measuring cell in which a sample gas is burned. If the sample gas ignites successfully, the amount of energy or calorific value, as the case may be, of the gas emitted during combustion is determined and, if necessary, natural gas is added to the flare gas.

In a metallurgical melting method described in WO 2016/123666, material comprising carbon is fed to a molten bath of metal and slag in a direct melting vessel, wherein hot gas from furnaces is fed to a gas space above the molten bath for the purpose of the post-combustion of the reaction gases of the molten bath. The resulting exhaust gas is used with fuel combustion gas and combustion air containing oxygen to heat the furnaces, wherein the temperature of the gas space in the furnaces is controlled by feeding the exhaust gas with combustion gas and combustion air in a manner dependent on the oxygen content in the exhaust gas from the furnaces, when the exhaust gas falls below a certain calorific value.

In particular in secondary metallurgical processes, with which the degassing of a metal melt is provided, an exhaust gas comprising carbon monoxide is produced as a result of the reduction in the carbon content of the melt, into which fuel gas is introduced in constant quantities for post-combustion in order to ensure safe post-combustion. However, this approach does not do justice to the fact that typically in the degassing of metal melts, the exhaust gas composition and the exhaust gas volume flow vary during the course of the method. Therefore, for safe post-combustion of the exhaust gas, it is necessary to add appropriate quantities of fuel gas, typically natural gas, to the exhaust gas. Apart from the fact that the increased consumption of combustion gas results in increased costs, such an approach is also accompanied by increased emissions of carbon dioxide, which is not desirable from an environmental point of view.

SUMMARY

The disclosure provides a method for the post-combustion of exhaust gases comprising carbon monoxide from metallurgical processes with discontinuously generated exhaust gas volumes and exhaust gas compositions, which enables the safe post-combustion of exhaust gases with a lower environmental impact.

One aspect of the invention relates to a method for post-combustion of exhaust gases comprising carbon monoxide from metallurgical processes with discontinuously generated exhaust gas volumes, the composition of which varies during a period within which exhaust gas is generated. The method comprises conditioning of the exhaust gas prior to the post-combustion, in such a way that at least one combustion gas and/or one further additional gas is introduced in feedback-controlled fashion into the exhaust gas upstream of the post-combustion. The feedback control is performed in a manner dependent on the composition of the exhaust gas and/or in a manner dependent on the exhaust gas volume flow.

With the method, the post-combustion of the exhaust gas preferably takes place with an open flame in the region of the mouth of an exhaust gas channel to the atmosphere. Alternatively, the post-combustion of the exhaust gas can take place in a combustion chamber provided for this purpose.

Both the calorific value of the exhaust gas and the exhaust gas volume flow are controlled such that, on the one hand, a combustion that is as complete as possible is secured and, on the other hand, it is ensured that the exhaust gas volume flow is set in such a way that a flow velocity of the exhaust gas in the cross-section concerned is set in, which flow velocity is smaller than a flame propagation velocity of the exhaust gas, such that the re-ignition of the exhaust gas into an exhaust gas channel is ruled out.

The exhaust gas composition and the exhaust gas volume flow are mutually dependent, especially if an inert gas is added as an additional gas. It is expedient to feed nitrogen to the exhaust gas as an additional gas, in order to increase the exhaust gas volume flow. This reduces the calorific value of the exhaust gas, which means that the quantity of combustion gas that is introduced, for example in the form of natural gas, may have to be increased.

With a preferred variant of the method, it is provided that a calorific value of the exhaust gas is determined indirectly via the carbon monoxide content of the exhaust gas using at least one device for gas analysis. For this purpose, results from a gas analysis, which is required in any event, can be used in secondary metallurgical processes.

Accordingly, it can be provided that the feedback control takes place in a manner dependent on the carbon monoxide content of the exhaust gas, with the feedback control objective of the greatest possible conversion of carbon monoxide to carbon dioxide, such that essentially stoichiometric post-combustion is ensured.

With a particularly preferred variant of the method, it is provided that the feedback control is guided in such a way that the calorific value of the exhaust gas does not fall below $\geq 2$ kWh/Nm$^3$ ($\geq 200$ BTU/scf). Surprisingly, it has been found that, with such a calorific value, a post-combustion of carbon monoxide of over 97% is possible.

Furthermore, the feedback control can be configured in such a way that the exhaust gas volume flow does not fall below a given minimum volume flow.

Expediently, the minimum volume flow of the exhaust gas is determined in a manner dependent on the flow velocity of the exhaust gas in a given flow cross-section, such that the flow velocity is smaller than the flame propagation velocity of the exhaust gas during combustion. Typical flame propagation velocities are of the order of magnitude of 0.2 to 0.5 m/s.

Preferably, the post-combustion is carried out by at least one supporting gas flare stack arranged in or on a flue.

Introducing combustion gas and/or additional gas or inert gas, as the case may be, is expediently performed via separate feed lines with valves that can be regulated in terms of volume flow, which are controlled by means of a software controller, for example. Such a controller can be realized, for example, by means of a programmable logic controller.

The disclosure furthermore relates to a method for exhaust gas aftertreatment during a vacuum treatment of liquid steel in a secondary metallurgical process comprising the post-combustion of the exhaust gases from the vacuum treatment of a metal melt by means of at least one flare stack in or at an exhaust gas channel of a vacuum pump. The method comprises conditioning of the exhaust gas prior to the post-combustion, in such a way that at least one combustion gas and/or one additional gas is introduced in feedback-controlled fashion into the exhaust gas upstream of the post-combustion. The feedback control is performed in a manner dependent on the composition of the exhaust gas and in a manner dependent on the exhaust gas volume flow.

Vacuum treatment of liquid steel is typically a batch method, with which the exhaust gas aftertreatment in accordance with the disclosure is particularly useful and appropriate. Exhaust gas aftertreatment preferably takes place in secondary metallurgical processes such as, for example, VD, VD-OB, RH, RH-TOP, RH-OB, VacAOD VODC or VOD processes.

In a particularly preferred variant of this method, it is provided that the post-combustion is carried out periodically only during the decarbonization phase of the metal melt. If the CO content of the exhaust gas falls below a specified minimum value that is significantly lower than the value that would justify an increase in the calorific value with combustion gas, preferably no post-combustion takes place. This is due to the fact that, during the degassing of a melt, which in itself is already a discontinuous process, exhaust gases comprising carbon monoxide are produced only during a certain time period.

Post-combustion is only useful and necessary during such time period.

The disclosure furthermore relates to a post-combustion device for post-combustion of exhaust gas during a vacuum treatment of liquid steel in a secondary metallurgical process. The device comprises at least one flare stack at an exhaust outlet of an exhaust gas channel of a vacuum pump of a secondary metallurgical plant, means for feeding combustion gas to the flare stack, means for feeding an inert gas into the exhaust gas channel of the vacuum pump upstream of the flare stack, means for ascertaining the exhaust gas volume flow and/or for measuring the exhaust gas velocity within the exhaust gas channel, means for analyzing the exhaust gas composition, means for metering the combustion gas and the inert gas, and means for feedback control of the metering of the combustion gas and/or the inert gas in a manner dependent on the exhaust gas composition.

The means for metering the combustion gas and the inert gas can be volume-flow controllable valves, each of which is arranged in feed lines for combustion gas and for natural gas, which are connected to the exhaust gas channel.

Preferably, at least one control device is provided as a means for metering combustion gas and/or inert gas, the input variables of which are exhaust gas composition, exhaust gas volume flow, the quantity of combustion gas fed and the quantity of inert gas fed.

With a preferred variant of the post-combustion device, it is provided that the feedback control device comprises at least one programmable logic controller.

Furthermore, the feedback control device can control a support burner of the flare stack in such a way that the operation of the flare stack is provided only when exhaust gas comprising CO is produced.

The invention is explained below with reference to the accompanying drawings.

DETAILED DESCRIPTION

Figure 1:
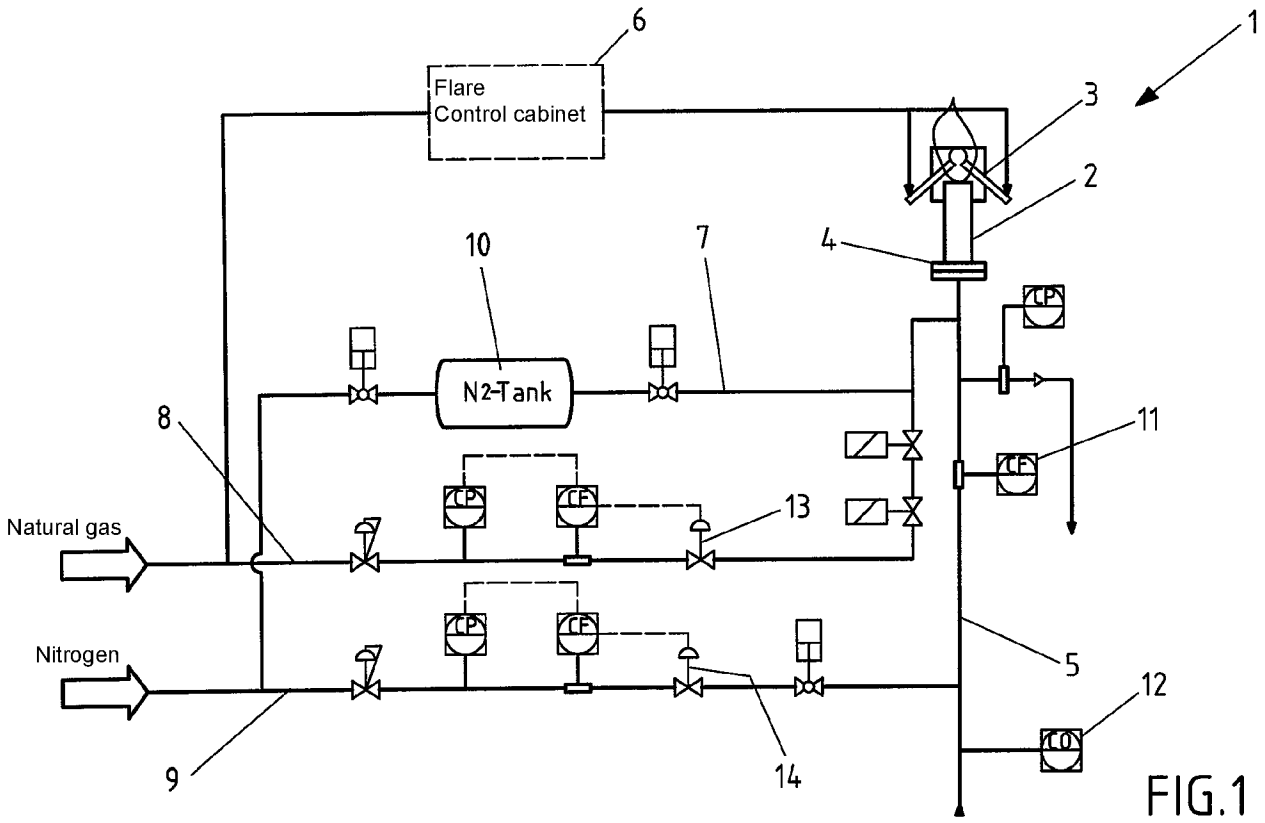
FIG. 1 is a schematic representation of the post-combustion device at a secondary metallurgical facility.

Reference is initially made to the post-combustion device 1 shown in FIG. 1, which comprises a flare stack 2 with a support burner 3, which is connected to the exhaust outlet 4 of an exhaust gas channel 5 of a vacuum pump (not shown) of a metallurgical plant. For example, the metallurgical plant may include a casting ladle and devices for degassing the metal melt contained in the casting ladle. The degassing of the metal melt can be performed, for example, by a partial-quantity degassing process, such as the Ruhrstahl-Heraeus process, with which a vacuum vessel is immersed in the melt for degassing, wherein negative pressure is generated in the vacuum vessel via vacuum pumps designed as steam jet pumps to degas the melt. Typically, multi-stage vacuum pumps, which are connected to an exhaust gas channel 5, are used for this purpose. For reasons of simplification, the term "vacuum pump" is predominantly used in the singular in the present application. However, "vacuum pump" also refers to an arrangement of vacuum pumps or a pump with a plurality of pump stages.

The support burner 3 of the flare stack 2 can be put into and out of operation or ignited and extinguished, as the case may be, via a control device 6.

Upstream of the flare stack 2, the exhaust gas channel 5 is connected to an extinguishing line 7, a feed line 8 for combustion gas and a feed line 9 for nitrogen. Via the extinguishing line 7, nitrogen can be fed as an extinguishing agent from an extinguishing agent tank 10 to the exhaust gas channel 5.

A flow measuring device 11 for determining the exhaust gas volume flow is arranged in the exhaust gas channel 5 upstream of the mouth of the feed line 8 for combustion gas into the exhaust gas channel 5 and downstream of the mouth of the feed line 9 for nitrogen. Upstream of the mouth of the feed lines 9 into the exhaust gas channel, a gas analysis device 12, which is preferably used to continuously determine the exhaust gas composition, is also provided. Depending on the exhaust gas composition and the flow through the exhaust gas channel 5 the feed of combustion gas and nitrogen as inert gas into the exhaust gas channel 5 is controlled by means of a control device 21, the feedback control scheme of which is explained below on the basis of the representation in FIG. 2. The feedback control device 21, which is shown in simplified form in FIG. 3, controls valves 13, 14 provided in the feed lines 8, 9, each of which meters more or less combustion gas or inert gas or nitrogen, as the case may be, into the exhaust gas channel 5.

Figure 2:
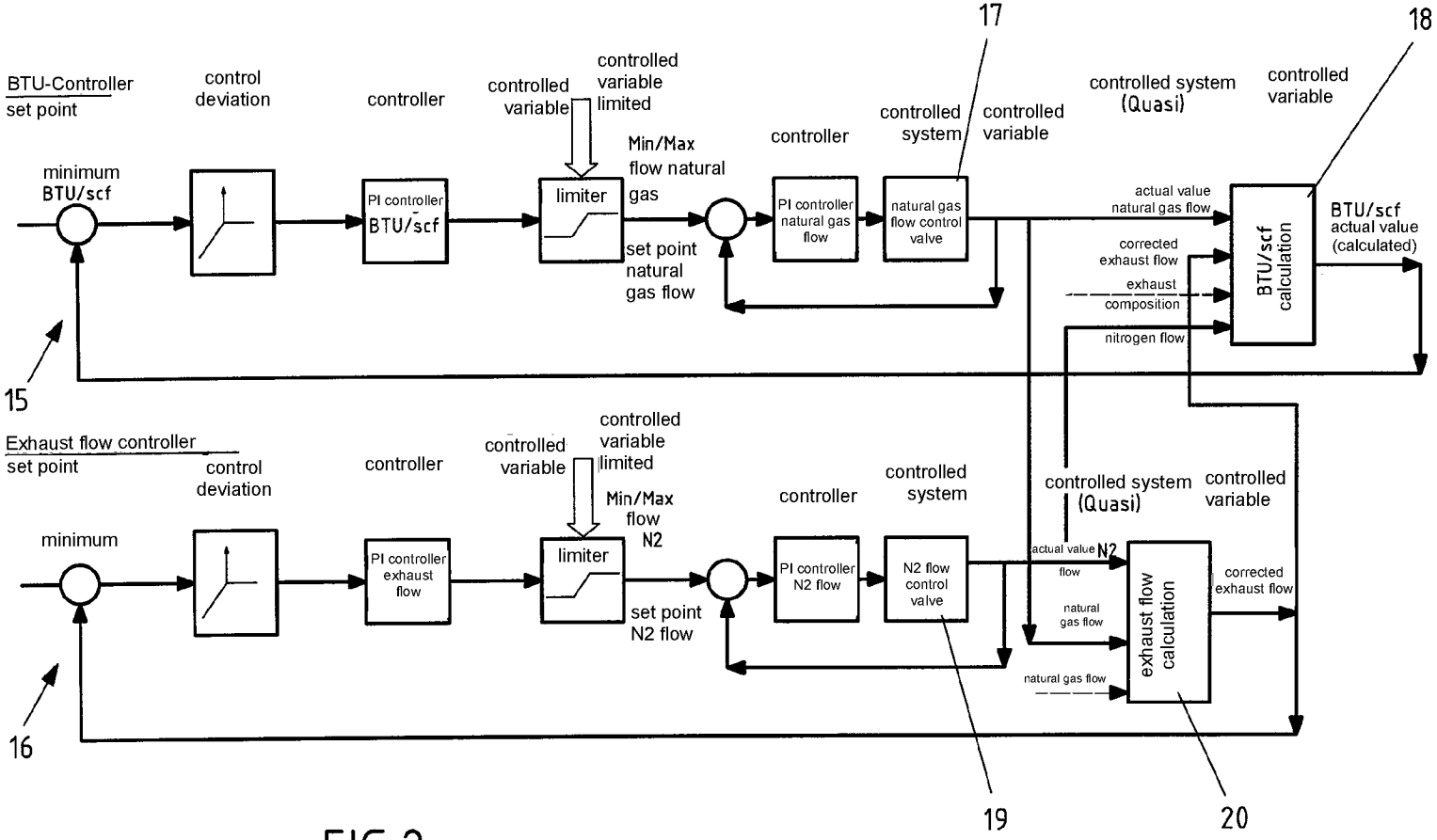
FIG. 2 shows a control scheme of the method for the post-combustion of exhaust gases.
Figure 3:
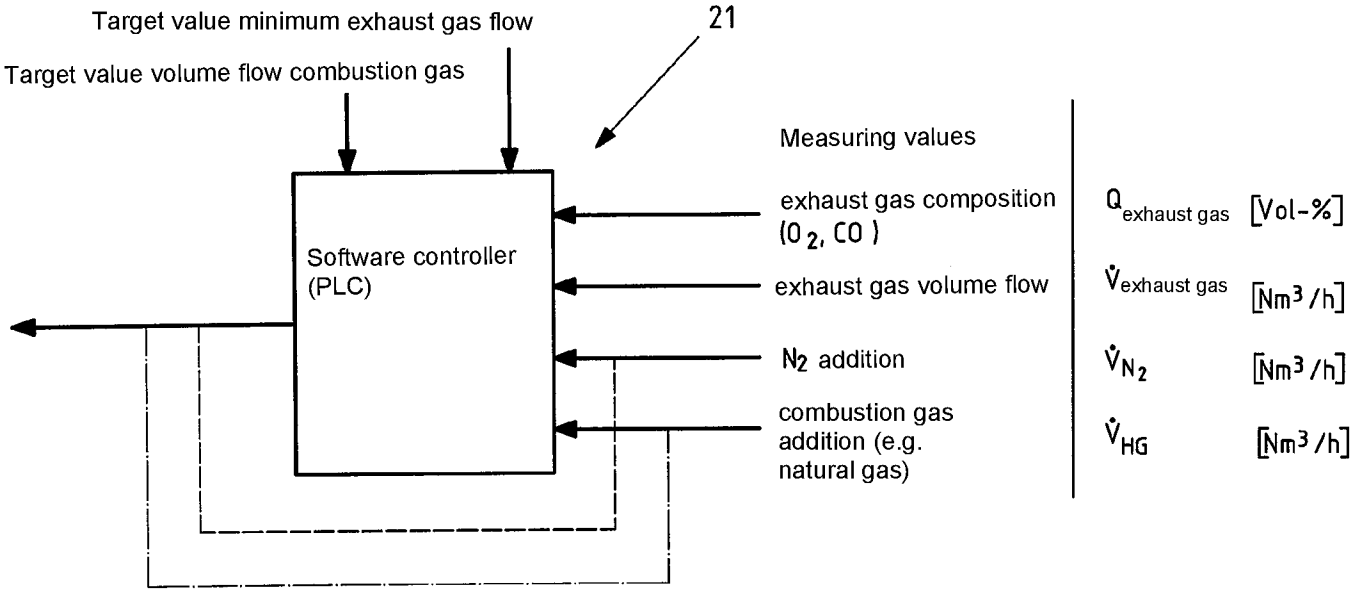
FIG. 3 is a schematic representation of the controller used in the feedback control method.

The feedback control scheme shown in FIG. 2 comprises two interdependent control loops 15, 16, wherein a first control loop 15 controls the calorific value of the exhaust gas determined on the basis of the gas composition as a reference variable, and the second control loop 16 shown below in FIG. 2 controls the exhaust gas volume flow as a reference variable. The calorific value of the exhaust gas is determined from the measured values from the gas analysis device 12 via the CO content. The gas analysis device 12 provides, among other things, the oxygen content and the carbon monoxide content of the exhaust gas. The CO content or carbon monoxide content, as the case may be, of the exhaust gas determines its calorific value.

The calorific value of the exhaust gas further depends on the nitrogen content of the exhaust gas. The exhaust gas volume flow must not fall below a certain minimum value, in order to ensure sufficient gas velocity and thus prevent a possible re-ignition in the exhaust gas channel. To ensure this, an appropriate quantity of inert gas or nitrogen, as the case may be, is fed to the exhaust gas channel, which in turn has a feedback effect on the calorific value of the exhaust gas. The calorific value of the exhaust gas should not fall below a specified minimum value, for example in the order of magnitude of ≥2 kWh/Nm$^3$ (200 BTU/scf). This value corresponds to a stoichiometrically complete combustion of the CO.

The first control loop 15 includes a first control device 17 for combustion gas feed, which acts on the volume flow controllable valve 13 in the feed line 8 for combustion gas. The reference variable for the calorific value is specified via a calorific value calculator 18, which uses the actual calorific value, the exhaust gas volume flow, the exhaust gas composition and the actual nitrogen volume flow from the second control loop 16 as input variables.

The second control loop 16 includes a second control device 19 for the metering of nitrogen, which acts on the volume-flow controllable valve 14. The second control loop 16 further includes a volume flow calculator 20, which uses the actually fed nitrogen volume flow and the combustion gas volume flow as input variables. The volume flow calculator 20 specifies the reference variable for the minimum exhaust gas volume flow and supplies this value in parallel to the calorific value calculator 18.

Figure 4:
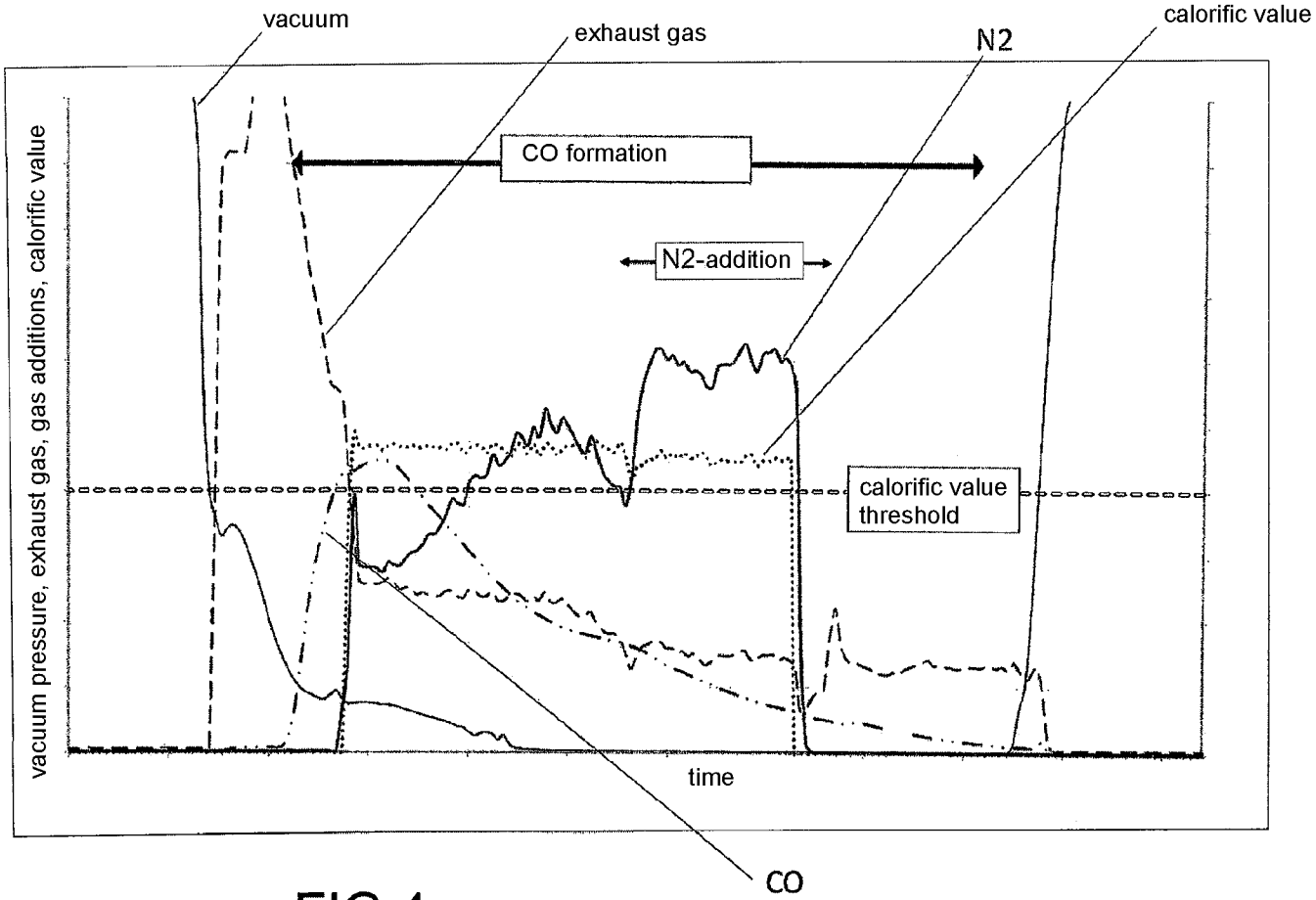
FIG. 4 is a representation showing the exhaust gas composition and the exhaust gas quantity during a degassing process, wherein the feedback control intervention prior to post-combustion is also shown.

FIG. 4 illustrates the exhaust gas composition and the exhaust gas quantity during a typical degassing process of a secondary metallurgical treatment of a molten steel, wherein the pressure prevailing during decarbonization, the exhaust gas quantity, the inert gas quantity, the natural gas quantity and the CO content of the exhaust gas are plotted over time. The pressure drop (vacuum/thin solid line) at the beginning of the degassing process and the pressure increase at the end of the degassing process can be easily recognized. This is accompanied by an initially high and then decreasing formation of CO. The dotted line illustrates the calorific value of the exhaust gas supported by the metering of natural gas ($CH_4$), whereas the bold solid curve illustrates the metering of nitrogen.

LIST OF REFERENCE SIGNS

1 Post-combustion device
2 Flare stack
3 Support burner
4 Exhaust outlet
5 Exhaust gas channel
6 Control device
7 Extinguishing line
8 Feed line for combustion gas
9 Feed line for nitrogen
10 Extinguishing agent tank
11 Flow measuring device
12 Gas analysis device
13, 14 Valves
15 First control loop
16 Second control loop
17 First control device
18 Calorific value calculator
19 Second control device
20 Volume flow calculator
21 Control device

The invention claimed is:

1. A method, comprising:

post-combusting an exhaust gas, wherein the exhaust gas comprises carbon monoxide from metallurgical processes, and wherein the exhaust gas has a discontinuously generated exhaust gas volume, and wherein a composition of the exhaust gas and/or a volume flow of the exhaust gas varies during a period within which the exhaust gas is generated, and conditioning the exhaust gas prior to post-combusting by introducing a combustion fuel gas and an inert gas in feedback-controlled fashion into the exhaust gas upstream of the post-combusting, wherein the feedback control is performed dependent on the composition of the exhaust gas and dependent on the volume flow of the exhaust gas.

2. The method according to claim 1, wherein the inert gas is nitrogen.

3. The method according to claim 1, further comprising:

determining a calorific value of the exhaust gas indirectly via a carbon monoxide content of the exhaust gas using a gas analyzer (12).

4. The method according to claim 1, wherein the feedback control takes place dependent on a carbon monoxide content of the exhaust gas, and wherein a feedback control objective is achieving a maximum conversion of carbon monoxide to carbon dioxide.

5. The method according to claim 1, wherein the feedback control is configured such that a calorific value of the exhaust gas does not fall below 200 BTU/scf.

6. The method according to claim 1, wherein the feedback control is configured such that the volume flow of the exhaust gas does not fall below a given minimum volume flow.

7. The method according to claim 6, wherein the minimum volume flow of the exhaust gas is determined dependent on a flow velocity of the exhaust gas in a given flow cross-section, such that the flow velocity is greater than a flame propagation velocity of the exhaust gas during combustion.

8. The method according to claim 1, wherein the post-combustion is carried out by a supporting gas flare stack (2) arranged in or on a flue.

9. The method according to claim 8, wherein the introducing the combustion fuel gas and the inert gas is performed via feed lines (8, 9) with valves (13, 14) that can be regulated in terms of volume flow.

10. A method, comprising:

exhaust gas aftertreatment during vacuum treatment of liquid steel in a metallurgical process comprising post-combustion of exhaust gas stemming from vacuum treatment of a metal melt by a flare stack (2) in or at an exhaust gas channel (5) of a vacuum pump, and conditioning the exhaust gas prior to the post-combustion by introducing a combustion fuel gas and an additional gas in feedback-controlled fashion to the exhaust gas upstream of the post-combustion, wherein the feedback control is performed dependent on a composition of the exhaust gas and dependent on a volume flow of the exhaust gas.

11. The method according to claim 10, wherein the post-combustion is carried out periodically only during a decarbonization phase of the metal melt.

12. A post-combustion device for post-combustion of exhaust gas during vacuum treatment of liquid steel in a secondary metallurgical process, comprising:

at least one flare stack (2) at an exhaust outlet (4) of an exhaust gas channel (5) of a vacuum pump of a secondary metallurgical plant;

a first valve for introducing combustion fuel gas to the flare stack;

a second valve for introducing an inert gas into the exhaust gas channel of the vacuum pump upstream of the flare stack (2);

a sensor for measuring a volume flow of the exhaust gas and/or for measuring a velocity of the exhaust gas within the exhaust gas channel (5);

an analyzer for analyzing an exhaust gas composition; and a controller for feedback control of the first valve and the second valve dependent on the exhaust gas composition.

13. The post-combustion device according to claim 12, wherein the first valve is a volume-flow controllable valve (13) arranged in a first feed line (8) for the combustion fuel gas, the first feed line (8) being connected to the exhaust gas channel (5), and wherein the second valve is a volume-flow controllable valve (14) arranged in a second feed line (9) for the inert gas, the second feed line (9) being connected to the exhaust gas channel (5).

14. The post-combustion device according to claim 12, wherein the controller processes the following input variables:

the exhaust gas composition, a volume flow of the exhaust gas, a quantity of combustion fuel gas fed, and a quantity of inert gas fed.

15. The post-combustion device according to claim 12, wherein the controller is a programmable logic controller.

16. The post-combustion device according to claim 12, wherein the controller controls a support burner (3) of the flare stack (2).

* * * * *